US008373611B2

(12) United States Patent
Oh et al.

(10) Patent No.: US 8,373,611 B2
(45) Date of Patent: Feb. 12, 2013

(54) PROBE AND ANTENNA USING WAVEGUIDE

(75) Inventors: Soon-Soo Oh, Daejeon (KR); Jung-Ick Moon, Daejon (KR); Joung-Myoun Kim, Daejon (KR); Soon-Ik Jeon, Daejeon (KR); Chang-Joo Kim, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 605 days.

(21) Appl. No.: 12/629,836

(22) Filed: Dec. 2, 2009

(65) Prior Publication Data

US 2010/0134370 A1 Jun. 3, 2010

(30) Foreign Application Priority Data

Dec. 3, 2008 (KR) ..... 10-2008-0121833

(51) Int. Cl.
*H01Q 13/00* (2006.01)
*H01P 1/00* (2006.01)

(52) U.S. Cl. ..... 343/772; 343/785; 333/248; 333/208

(58) Field of Classification Search ..... 343/785, 343/772; 333/208, 248
See application file for complete search history.

(56) References Cited

U.S. PATENT DOCUMENTS

| | | | |
|---|---|---|---|
| 4,990,870 | A | 2/1991 | Reindel |
| 2002/0027483 | A1 | 3/2002 | Sasaki |
| 2004/0017272 | A1 | 1/2004 | Smith et al. |
| 2007/0024399 | A1 | 2/2007 | Martin Antolin et al. |

FOREIGN PATENT DOCUMENTS

| | | | |
|---|---|---|---|
| JP | 2002-100912 | | 4/2002 |
| KR | 10-2002-0020235 | A | 3/2002 |
| KR | 10-0834422 | | 5/2008 |

OTHER PUBLICATIONS

Hrabar, S. et al., "Waveguide Miniaturization Using Uniaxial Negative Permeability Metamaterial", IEEE Transactions on Antennas and Propagation, vol. 53, No. 1, Jan. 2005, pp. 110-119.

*Primary Examiner* — Dieu H Duong
(74) *Attorney, Agent, or Firm* — Rabin & Berdo, P.C.

(57) ABSTRACT

A probe and an antenna, more particularly, a probe and antenna using a waveguide, which reduces the multiple reflection of electromagnetic waves. The probe includes: and the antenna each include a waveguide and a resonance unit is entirely or partially disposed in the inside of the waveguide, and comprising the resonance unit including a conductor.

7 Claims, 3 Drawing Sheets

PROBE AND ANTENNA USING WAVEGUIDE

CROSS-REFERENCE(S) TO RELATED APPLICATIONS

The present application claims priority of Korean Patent Application No(s). 10-2008-0121833, filed on Dec. 3, 2008, which is incorporated herein by reference in its entirety.

BACKGROUND OF THE INVENTION

1. Field of the Invention

Exemplary embodiments of the present invention relates to a probe and an antenna; and, more particularly, to a probe and antenna using a waveguide.

2. Description of Related Art

An antenna is a generic term of devices for transmitting or receiving electromagnetic waves. A probe in a wide sense refers to an antenna for receiving electromagnetic waves, and in a narrow sense refers to an electromagnetic wave receiver used for measuring electromagnetic fields.

Probes or antennas using waveguides have been known. A waveguide is a type of transmission lines for transmitting electromagnetic waves or electrical energy. A waveguide has a conductive cavity through which electromagnetic waves are transmitted. In general, since a waveguide has low ohmic loss and low dielectric loss, it is widely used in probes and antennas.

Meanwhile, in probes and antennas, multiple reflection is frequently problematic. The multiple reflection refers to a phenomenon in which an electromagnetic wave is several times reflected between two specific objects. The following description will be made with reference to an example which measures characteristics of an antenna by using a probe to measure an electromagnetic field around the antenna.

With regard to characteristics of the antenna, a space electromagnetically influenced by the antenna may be largely divided into a far field and a near field. The far field represents a space far away from the antenna by more than several times the wavelength of the electromagnetic wave used in the antenna, generally, more than three to five times. The near field represents a space far away from the antenna by less than several times the wavelength of the electromagnetic wave used in the antenna. It can be understood that the far field represents a space farther than a location where the electromagnetic field is completely formed from the antenna and thus it is isolated from the antenna. Also, it can be understood that the near field represents a space covering a location where the electromagnetic field is formed from the antenna.

Generally, an antenna transmits or receives electromagnetic waves by using an electromagnetic field formed in a far field. Therefore, characteristics of an antenna are usually measured in a far field. In some cases, however, characteristics of an antenna may be measured in a near field, and characteristics of an antenna in a far field may be calculated mathematically. Examples of such cases may include a case where a transmission loss is high because a measurement frequency is high, a case where an object to be measured is significantly large compared with the wavelength of an electromagnetic wave, and a case where far field measurement conditions are not met because of limitations in a measurement environment.

In such cases, a probe is disposed in a near field space, and characteristics of an antenna are measured. In those cases, an electromagnetic wave reception unit of the probe and a radiator of the antenna become very close to each other. Therefore, the multiple reflection of an electromagnetic wave may occur between the probe and the antenna. The probe may accurately measure characteristics of the antenna when it receives only electromagnetic waves radiated directly from the antenna. However, if characteristics of an antenna are measured in a near field, electromagnetic waves radiated from the antenna may be reflected one or more times at the probe or the antenna and then incident into the probe. Such a multiple-reflected electromagnetic wave serves as an error factor in measurement.

Furthermore, in a case where a frequency band of a signal to be measured is low, a wavelength of an electromagnetic wave is long and therefore a distance between a probe and an antenna must be large. Since characteristics of an antenna are usually measured inside a shield room or the like, there may be a limitation in increasing the distance between the probe and the antenna. In some cases, due to another limitation in a measurement environment, the distance between the probe and the antenna must be maintained to be narrow. In those cases, the distance between the probe and the antenna may be reduced by decreasing the multiple reflection of an electromagnetic wave.

Therefore, there is a need for methods which are capable of reducing the multiple reflection of electromagnetic waves in probes or antennas.

SUMMARY OF THE INVENTION

An embodiment of the present invention is directed to a probe and an antenna capable of reducing the multiple reflection of electromagnetic waves.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a probe includes: a waveguide; and a resonance unit entirely or partially disposed in the inside of the waveguide and comprising a conductor.

In accordance with another embodiment of the present invention, an antenna includes: a waveguide; and a resonance unit entirely or partially disposed in the inside of the waveguide and comprising a conductor.

DESCRIPTION OF SPECIFIC EMBODIMENTS

Figure 1:
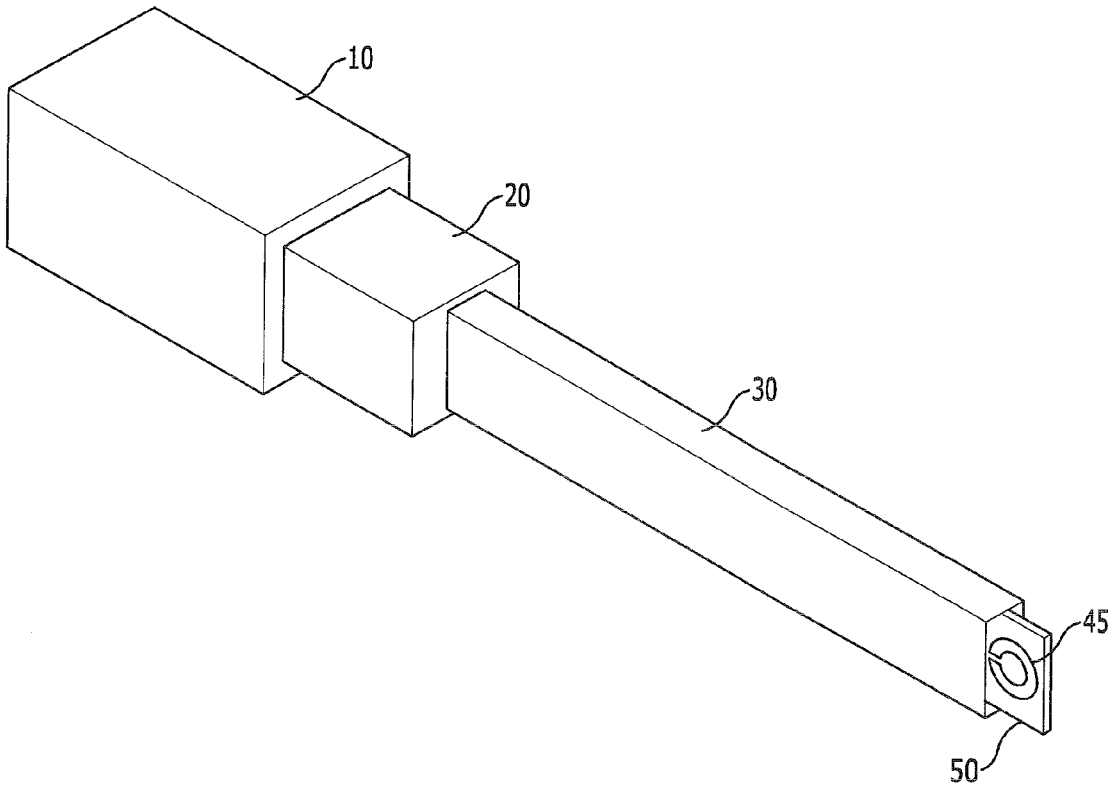
FIG. 1 is a perspective view of a probe in accordance with an embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

Exemplary embodiments of the present invention relate to a probe or an antenna using a waveguide and a resonance unit.

The principle of the invention will be described, taking an example that measures characteristics of an antenna in a near field by using a probe. In order to accurately measure characteristics of an antenna, the probe must receive only electromagnetic waves radiated directly from the antenna. However, if characteristics of the antenna are measured in a near field, the multiple reflection may be caused. That is, since an opening side of the probe and a radiator of the antenna are very close to each other, electromagnetic waves multiple-reflected between the opening side of the probe and the radiator of the antenna may be received by the probe. Since the multiple-reflected electromagnetic waves are not electromagnetic waves radiated directly fro the antenna, they serve as an error factor in measuring characteristics of the antenna. Therefore, if the multiple reflection is reduced, characteristics of the antenna may be measured more accurately.

In this case, the multiple reflection of the electromagnetic waves may be reduced by decreasing an area of the opening area of the probe. Since the opening area of the probe is a region where electromagnetic waves can be reflected, the reflection of the electromagnetic waves may be reduced by decreasing the opening area of the probe. However, the opening area of the probe is closely associated with an operating frequency of the probe. Generally, if the opening area of the probe is small, the operating frequency of the probe is low. Therefore, in accordance with the embodiments of the present invention, the probe is designed to receive electromagnetic waves of a desired operating frequency band by using a resonance unit. The resonance unit is entirely or partially disposed in the inside of the waveguide, and includes a conductor. The conductor included in the resonance unit may resonate at the operating frequency band of the probe.

As such, the probe or the antenna using the waveguide and the resonance unit may further reduce the multiple reflection than other probe or antenna that operates at the same operating frequency band.

Hereafter, embodiments of the present invention will be described in detail with reference to the accompanying drawings.

<Probe>

A probe in accordance with an embodiment of the present invention will be described below in detail.

The probe in accordance with the embodiment of the present invention includes a waveguide and a resonance unit. The resonance unit is entirely or partially disposed inside the waveguide and includes a conductor. The waveguide is used as a transmission line through which electromagnetic waves or signals are transmitted, and it has a conductive cavity. The waveguide transmits electromagnetic waves confined inside, and has low ohmic loss because no current directly flows through the surrounding conductor. A section of the waveguide may have various shapes. Generally, the section of the waveguide may be rectangular or circular. The lowest frequency that can be transmitted through the waveguide is determined by the size of the section of the waveguide. As an operating frequency increases, the section of the waveguide decreases.

The resonance unit may include a dielectric and a conductive resonance element attached to the dielectric. The resonance element resonates in an operating frequency band of the probe. Thus, the probe may receive electromagnetic waves of desired frequencies through the resonance unit. The dielectric supports the resonance element and may be formed in a type of a dielectric substrate. In this case, the dielectric substrate may be formed of Frame Retadent 1 (FR1), FR2, FR4, Composite Epoxy Material-1 (CEM-1), CEM-3, or the like.

The probe may further include a ridge attached to the inside of the waveguide and connected to the dielectric. Generally, the ridge is an elongated conductor and increases the electromagnetic-wave transmission efficiency of the probe. The ridge may be disposed in a direction in which an electromagnetic wave is transmitted, or may be attached to an inner side of the waveguide. In another embodiment, a pair of ridges may be disposed. For example, a pair of ridges facing each other may be attached to opposite sides of the waveguide, respectively. In other embodiment, two pairs of ridges may be used.

In this case, the ridges may be connected to the dielectric, and the dielectric may be formed to protrude at the connection portion where the dielectric and the ridges are connected together. Electromagnetic waves received through the resonance unit are guided and transmitted by the ridges connected to the dielectric. The protrusion of the dielectric matches impedance between the dielectric and the ridge and thus increases the efficiency of electromagnetic wave transmission.

Meanwhile, the resonance element included in the resonance unit may be formed in a ring shape with a cut portion. That is, the resonance element may have a shape similar to alphabet "C". The resonance element resonates at a specific frequency band according to its material and shape. In particular, the resonance frequency of the resonance unit is most affected by the length of the resonance element. Generally, the resonance frequency becomes lower as the length of the resonance element becomes longer, and the resonance frequency becomes higher as the length of the resonance element becomes shorter. Compared with other resonance elements, the ring-shaped resonance element with a cut portion may have a long length in a relatively small space. Therefore, such a ring type resonance element may occupy a small space and resonate at a low frequency.

The ring-shaped resonance element with a cut portion may include a capacitor attached to the cut portion. The capacitor shifts the resonance frequency of the resonance element. In this case, the capacitor may be a variable capacitor. In a case where the variable capacitor is used, if a capacitance of the variable capacitor is changed, the resonance frequency of the resonance element is also changed. Consequently, the operating frequency of the probe may be changed using the variable capacitor.

Meanwhile, the resonance element included in the resonance unit may include a plurality of conductive elements electrically isolated from one another. The expression "electrically isolated" means that no current can flow because the conductive elements are not directly connected together, and does mean "electromagnetically isolated." Therefore, the plurality of conductive elements can transmit electromagnetic waves because they are electrically isolated from one another but electromagnetically coupled to one another.

The dielectric of the resonance unit may support the conductive elements. The conductive elements may be attached to one side or both sides of the dielectric. In a case where the conductive elements are attached to both sides of the dielectric, two conductive elements may be attached to one side of the dielectric, and the conductive elements attached to the other side of the dielectric may be arranged between the two conductive elements. Such an arrangement strengthens the electromagnetic coupling between the conductive elements. Therefore, such an arrangement may reduce the loss generated when the conductive elements transmit the electromagnetic waves.

Furthermore, the conductive elements may be arranged in a direction perpendicular to an opening side of the waveguide. Since the conductive elements transmit the electromagnetic waves, the loss during transmission is reduced when the conductive elements are arranged in a direction in which the electromagnetic waves are transmitted. In the waveguide, the electromagnetic waves are transmitted in a direction perpendicular to the opening side of the waveguide, that is, an extending direction of the waveguide. Therefore, the conductive elements may be arranged in this direction.

Hereafter, a probe in accordance with a specific embodiment of the present invention will be described with reference to the accompanying drawings.

Figure 2:
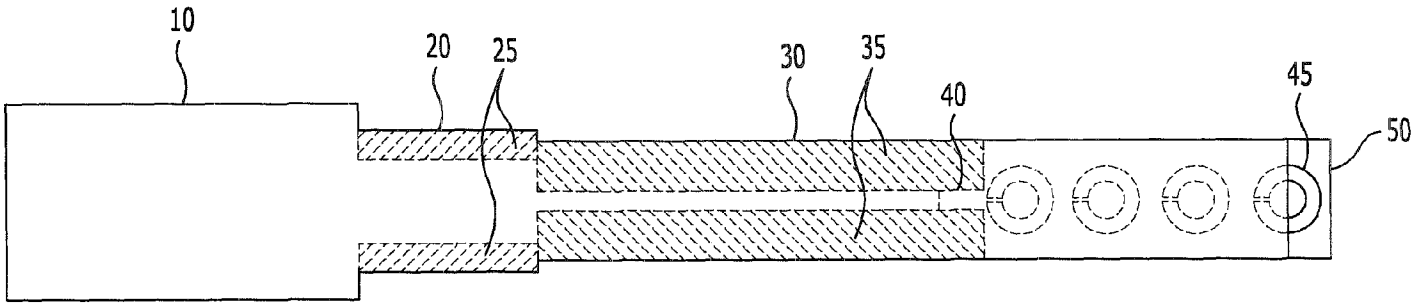
FIG. 2 is a front view of the probe of FIG. 1.
Figure 3:
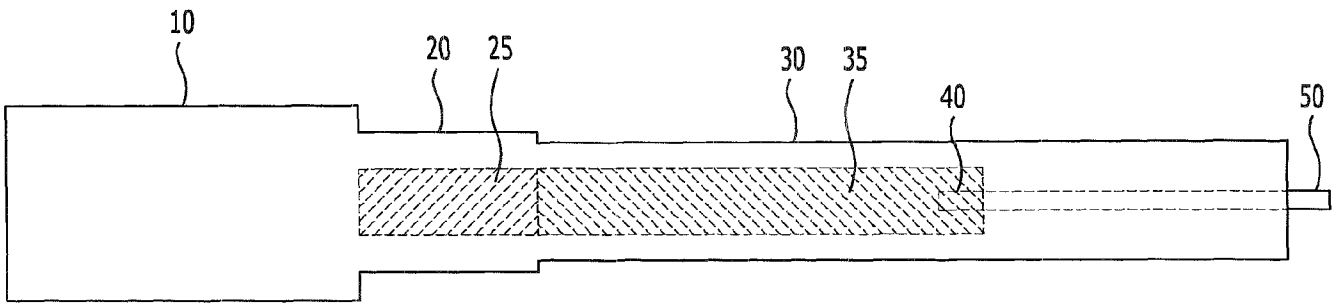
FIG. 3 is a plan view of the probe of FIG. 1.

FIGS. 1 to 3 are a perspective view, a front view, and a plane view of a probe 100 in accordance with an embodiment of the present invention, respectively. Referring to FIGS. 1 to 3, the probe 100 includes a first waveguide 10, a second waveguide 20, and a third waveguide 30.

The probe 100 may be used to measure the electromagnetic field of a near field.

The first waveguide 10, the second waveguide 20, and the third waveguide 30 have a rectangular section, and the height and width of their insides are constant in an extending direction of the waveguides. The second waveguide 20 has a smaller section than the first waveguide 10, and the third waveguide 30 has a smaller section than the second waveguide 20. Since the third waveguide 30 has the smallest section, it is possible to reduce the multiple reflection that may be caused when measuring the electromagnetic waves. Moreover, the measurement distance may become closer by as much as the reduced multiple reflection.

Generally, the waveguide functions as a high-pass filter (HPF). As the size of the section of the waveguide becomes smaller, a cutoff frequency of the waveguide becomes higher. If the third waveguide 30 is formed to have a small section in order to reduce the multiple reflection, the cutoff frequency of the third waveguide 30 may be much higher than the operating frequency band of the probe 100. Even in this case, the probe 100 may receive electromagnetic waves of the operating frequency band by using the resonance element 45. Further detailed description will be made below in conjunction with the resonance element 45.

When the probe 100 measures the electromagnetic waves, the electromagnetic waves are transmitted from the third waveguide 30 through the second waveguide 20 to the first waveguide 10. The second waveguide 20 matches impedance between the first waveguide 30 and the third waveguide 10.

The probe 100 may include an electromagnetic wave absorber at the outer sides of the waveguides 10, 20 and 30. The electromagnetic wave absorber increases an electromagnetic-wave measurement accuracy by absorbing electromagnetic waves radiated from the outside of the probe 100.

The probe 100 includes a first double ridge 25 attached to the inside of the second waveguide 20, and a second double ridge 35 attached to the inside of the third waveguide 30.

Referring to FIGS. 2 and 3, the first double ridge 25 is provided with a pair of ridges facing each other and attached to the inside of the second waveguide 20. The first double ridge 25 matches impedance between the first waveguide 10 and the third waveguide 30. The first double ridge 25 lowers a cutoff frequency of the second waveguide 20. The second double ridge 35 is provided with a pair of ridges and attached to the inside of the third waveguide 30. The second double ridge 35 lowers a cutoff frequency of the third waveguide 30. The first double ridge 25 and the second double ridge 35 narrow the inside of the waveguides and guide electromagnetic waves transmitted through the inside of the waveguides.

Furthermore, the probe 100 includes a dielectric 50, a portion of which is disposed in the inside of the third waveguide 30, and a resonance element 45 attached to the dielectric 50. As illustrated in FIGS. 1 to 3, the resonance element 45 and the dielectric 50 are disposed at one side of the third waveguide 30. The resonance element 45 and the dielectric 50 constitute a resonance unit of the probe 100.

As illustrated in FIGS. 1 to 3, the resonance element 45 includes a plurality of ring-shaped conductive elements with a cut portion. The resonance element 45 resonates at an operating frequency band of the probe 100. The probe 100 may receive electromagnetic waves of a desired frequency through the resonance element 45.

As the section of the third waveguide 30 becomes smaller, the multiple reflection may be further reduced. If the section of the third waveguide 30 is small, the cutoff frequency of the third waveguide 30 may be higher than the operating frequency of the probe 100. Generally, a transverse permeability of the waveguide is negative at a frequency band lower than the cutoff frequency. On the other hand, a permittivity of the resonance element is negative at the resonant frequency band. Therefore, a transverse permeability of the third waveguide 30 and a permittivity of the resonance element 45 are negative at the operating frequency band of the probe 100. When both the permeability and the permittivity are negative, the electromagnetic waves travel in the same manner as when both the permeability and the permittivity are positive. Due to this principle, the probe 100 may receive electromagnetic waves at the operating frequency band, while reducing the section of the third waveguide 30.

Meanwhile, the resonance element 45 includes a plurality of C-shaped conductive elements arranged in a row. As the third waveguide 30 becomes longer, the multiple reflection is further reduced. If the number of the conductive elements included in the resonance element 45 increases, the length of the third waveguide 30 increases. At this time, as the number of the conductive elements increases, the conductive and dielectric loss increases. However, the second double ridge 35 minimizes the conductive and dielectric loss. The second double ridge 35 may reduce the conductive and dielectric loss and lower the cutoff frequency of the third waveguide 30. It can be easily understood by those skilled in the art that a single conductive element may be used as the resonance element 45.

As illustrated in FIGS. 1 to 5, the dielectric 50 has a substrate shape and supports the resonance element 45. Referring to FIG. 3, which illustrates a plan view of the probe 100, the dielectric 50 is disposed in the center of the third waveguide 30. The dielectric 50 includes a protrusion 40 at a connection portion where the dielectric 50 and the second double ridge 35 are connected together. The protrusion 40 matches impedance between the third waveguide 30 and the dielectric 50.

Figure 4:
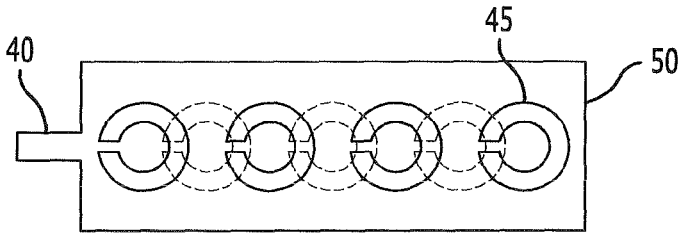
FIG. 4 is a sectional view of a resonance unit in accordance with an embodiment of the present invention.

FIG. 4 is a sectional view of the resonance unit in accordance with the embodiment of the present invention. The resonance unit includes the protrusion 40, the resonance element 45, and the dielectric 50.

As illustrated in FIG. 4, the resonance element 45 includes a plurality of C-shaped conductive elements. In this embodiment, the plurality of conductive elements are arranged on both sides of the dielectric 50 in a row. In FIG. 4, the conductive elements arranged on the front side of the dielectric 50 are indicated by solid lines, and the conductive elements arranged on the rear side of the dielectric 50 are indicated by dotted lines. The conductive elements on the rear side of the dielectric 50 are arranged in the intervals of the conductive elements on the front side of the dielectric 50. This arrange of the conductive elements increases the electromagnetic-wave transmission efficiency.

Figure 5:
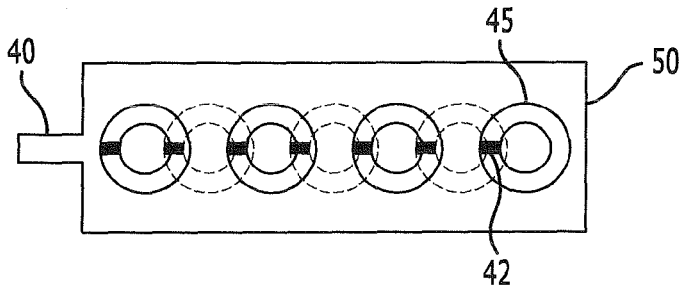
FIG. 5 is a sectional view of a resonance unit in accordance with another embodiment of the present invention.

FIG. 5 is a sectional view of a resonance unit in accordance with another embodiment of the present invention. In this embodiment, the plurality of conductive elements constituting the resonance element 45 include capacitors 42, respectively.

The capacitors 42 shift the resonant frequency of the resonance element 45. When the capacitances of the capacitors 42 are determined, the resonant frequency of the resonance element 45 is changed to a certain value. Meanwhile, when the capacitors 42 are variable capacitors, the resonant frequency of the resonance element 45 may be changed by adjusting the capacitances of the capacitors 42.

<Antenna>

An antenna in accordance with an embodiment of the present invention includes a waveguide and a resonance unit. The resonance unit is entirely or partially disposed in the inside of the waveguide.

The resonance unit may include a dielectric and a conductive resonance element attached to the dielectric. The antenna may further include a ridge attached to the inside of the waveguide and connected to the dielectric. The dielectric may be formed to protrude at a connection portion where the dielectric and the ridge are connected together.

Meanwhile, the resonance element may be formed in a ring shape with a cut portion, and may include a capacitor attached to the cut portion. Furthermore, the resonance element may include a plurality of conductive elements electrically isolated from one another. The conductive elements may be attached to one side of the dielectric and arranged in a direction perpendicular to an opening side of the waveguide. Meanwhile, the conductive elements may include two conductive elements attached to one side of the dielectric, and conductive elements attached the other side of the dielectric and arranged between the two conductive elements, and may be arranged in a direction perpendicular to an opening side of the waveguide.

The foregoing description of the probe may be applied to the antenna.

The probe and the antenna in accordance with the embodiments of the present invention may reduce the multiple reflection of electromagnetic waves.

While the present invention has been described with respect to the specific embodiments, it will be apparent to those skilled in the art that various changes and modifications may be made without departing from the spirit and scope of the invention as defined in the following claims.

What is claimed is:

1. A probe comprising:

a waveguide; and a resonance unit entirely or partially disposed in the inside of the waveguide and comprising a conductor, wherein the resonance unit comprises:

a dielectric; and a resonance element formed of the conductor and attached to the dielectric, wherein the resonance element comprises a plurality of conductive elements electrically isolated from one another, wherein the conductive elements comprise:

two conductive elements attached to one side of the dielectric; and an opposing conductive element attached to the other side of the dielectric and arranged between the two conductive elements, wherein the conductive elements are arranged in a direction perpendicular to an opening side of the waveguide.

2. The probe of claim 1, further comprising a ridge attached to the inside of the waveguide and connected to the dielectric.

3. The probe of claim 2, wherein the dielectric protrudes at a position where the dielectric and the ridge are connected together.

4. The probe of claim 1, wherein the resonance element comprises a cut portion.

5. The probe of claim 4, wherein the resonance element comprises a capacitor attached to the cut portion.

6. The probe of claim 1 wherein the conductive elements are attached to one side of the dielectric and arranged in a direction perpendicular to an opening side of the waveguide.

7. An antenna comprising:

a waveguide; and a resonance unit entirely or partially disposed in the inside of the waveguide and comprising a conductor, wherein the resonance unit comprises:

a dielectric; and a resonance element formed of the conductor and attached to the dielectric, wherein the resonance element comprises a plurality of conductive elements electrically isolated from one another, wherein the conductive elements comprise:

two conductive elements attached to one side of the dielectric; and an opposing conductive element attached to the other side of the dielectric and arranged between the two conductive elements, wherein the conductive elements are arranged in a direction perpendicular to an opening side of the waveguide.

* * * * *